US005087042A

United States Patent [19]

Solheim

[11] Patent Number: 5,087,042

[45] Date of Patent: Feb. 11, 1992

[54] GOLF CLUB GRIP

[75] Inventor: Karsten Solheim, Phoenix, Ariz.

[73] Assignee: Karsten Manufacturing Corporation, Phoenix, Ariz.

[21] Appl. No.: 653,646

[22] Filed: Feb. 11, 1991

Related U.S. Application Data

[63] Continuation-in-part of Ser. No. 573,326, Aug. 27, 1990, abandoned.

[51] Int. Cl.[5] ..... A63B 53/14

[52] U.S. Cl. ..... 273/81 B; 273/163 R; 273/81 R; D21/222

[58] Field of Search ..... 273/81 R–81 D, 273/81.2–81.6; D21/221, 222

[56] References Cited

U.S. PATENT DOCUMENTS

| | | | |
|---|---|---|---|
| De. 257,784 | 1/1981 | Forys et al. | D21/222 |
| De. 307,169 | 4/1990 | Aldridge | D21/222 |
| 1,587,082 | 6/1926 | Mattern | 273/81 B |
| 1,604,696 | 10/1926 | Jordy | D21/222 |
| 2,155,517 | 4/1939 | Turner | 273/81 B |
| 2,280,382 | 4/1942 | Davis | D21/222 |
| 2,446,622 | 8/1948 | Turner | D21/222 |
| 2,865,635 | 12/1958 | Jessen | 273/163 R |
| 4,919,420 | 4/1990 | Sato | 273/81 B |
| 4,974,846 | 12/1990 | Fenton | 273/81 B |

FOREIGN PATENT DOCUMENTS

| | | | |
|---|---|---|---|
| 451133 | 9/1948 | Canada | 273/81 R |
| 474058 | 10/1937 | United Kingdom | 273/81 B |
| 547946 | 9/1942 | United Kingdom | 273/81 R |
| 2230195 | 10/1990 | United Kingdom | 273/81 B |

OTHER PUBLICATIONS

Cleveland Classic 1989 Catalog, p. 4.

Golf Magazine, May 1990 issue, vol. 32, No. 5, Spalding Advertisement.

*Primary Examiner*—Edward M. Coven

*Assistant Examiner*—Steven B. Wong

*Attorney, Agent, or Firm*—Herbert E. Haynes, Jr.

[57] ABSTRACT

A grip for use on the extending end of the shaft of a golf club is provided with an especially configured array of longitudinally extending grooves which are in direct opposition to the rotation of the golf club about the longitudinal axis of the golf club shaft to resist twisting of the golf club in the golfer's hand resulting from mis-hitting of a golf ball in an off center location toward the toe or heel of the golf club head. The grip may have a visual indicator by which the rotational position of the golf club when being held in a golfer's hands can be determined by visual alignement of the grip with the golfer's hands.

24 Claims, 4 Drawing Sheets

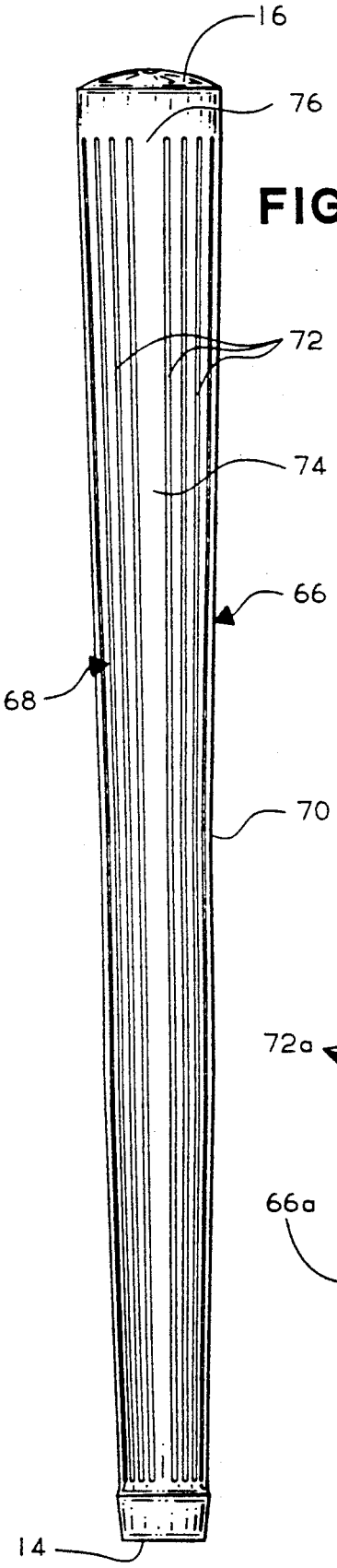
FIG. 6
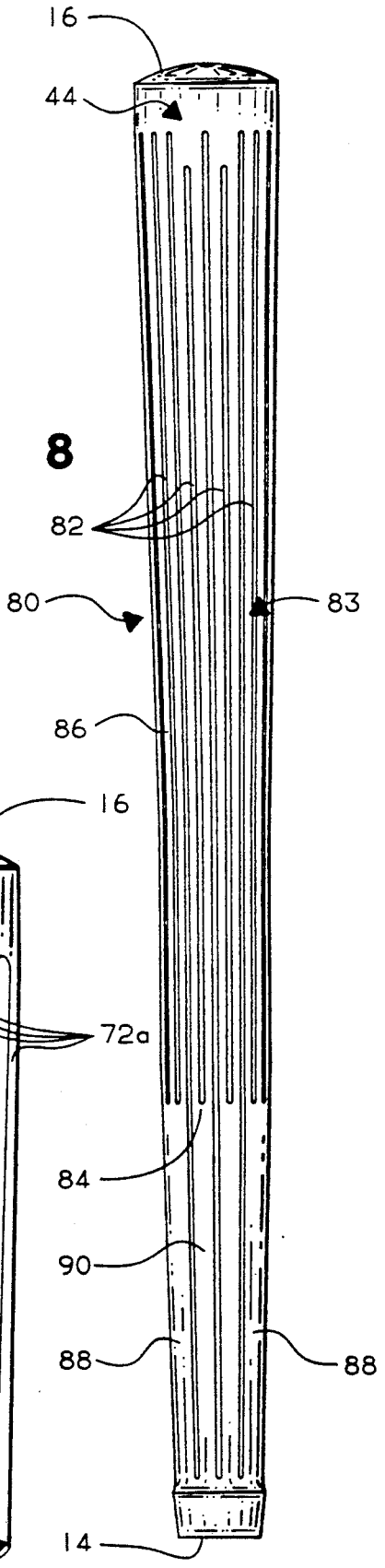
FIG. 8
FIG. 7
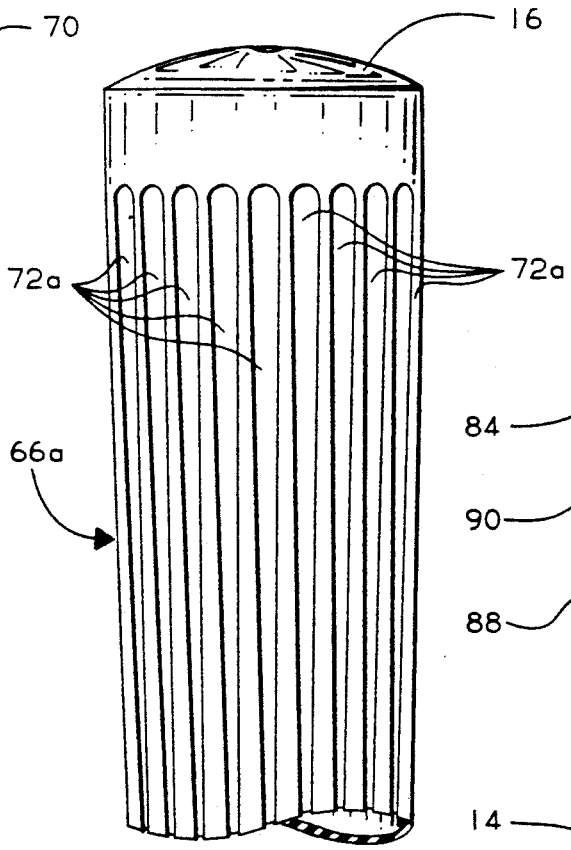

GOLF CLUB GRIP

CROSS REFERENCED TO RELATED APPLICATIONS

This application is a continuation-in-part of a copending patent application, Ser. No. 573,326, filed on Aug. 27, 1990 for a golf club grip by the same applicant now abandoned. BACKGROUND OF THE INVENTION 1. Field of the Invention The present invention relates generally to golf club grips and more specifically to a golf club grip which is configured to improve the resistance to axial rotation of a golf club in a golfer's hands.

2. Description of the Prior Art

Axial rotation or twisting of a golf club in a golfer's hands is often a direct result of mis-hitting of a golf ball. Every golf club has what is referred to as a sweet spot which is located proximate the center of gravity of the golf club head. When a golfer hits a golf ball on, or near the sweet spot of the club, maximum distance and directional accuracy will result if all the other factors which enter into a golf swing are proper. When this ideal condition exists, little or no torsion force is applied to the golf club which would tend to cause it to twist, or rotate about the longitudinal axis of the golf club shaft. However, even the best golfers will miss the sweet spot sometimes and such mis-hits in a direction toward the toe or toward the heel of the club head will exert rotational forces which tend to cause the golf club to twist in the golfer's hands.

This tendency for twisting of golf clubs in the golfer's hands as a result of mis-hits of the type described above has been well known for a long time and especially designed golf club heads known as "perimeter weighted" golf clubs have come into widespread use to help off set this club twisting problem. It will be appreciated that golf club grips also are an important factor in counteracting the club twisting problem.

Several types and designs of golf club grips have been developed over the years. A grip which was at one time used extensively but is not as popular as it once was, is made by wrapping an elongated strip of leather about the upper end of the golf club shaft. A suitable adhesive, usually in the form of double-sided tape is used to attach this type of grip to the shaft.

By far the most widely used golf club grips today are those formed of a rubber composition by an injection molding process. These grips are of tubular frusto-conical configuration; i.e. tapered, and have a smaller diameter open lower end with its larger diameter upper end being closed by an integrally molded end cap. These rubber molded grips are slidably mounted in a coaxially disposed position on the upper extending end of the golf club shaft, and affixation is normally accomplished with a double-sided adhesive tape.

In recent years, grips molded of synthetic materials, such as silicone based compositions, have begun to appear in the marketplace. Such synthetic grips are similar in all respects to the rubber molded grips except for the materials of which they are made, and they are mounted and affixed on the ends of the golf club shafts in the same way.

One of the more important design objectives of golf club grips is to provided the golfer with maximum club gripping capability without requiring the application of excessive gripping pressure. To accomplish this objective, all of the materials of which golf club grips are made have some degree of tackiness, and the surfaces of the grips are porous or otherwise irregular to enhance the static friction exerting capabilities of the grip. The static friction exerting capability of golf club grips is further enhanced in the molded grips described above by providing those grips with a groove pattern. In addition to being decorative, such groove patterns act much like the tread patterns of automobile tires thus increasing the traction between the grip and a golfer's hands.

The static friction exertion capabilities of golf club grips is intended to counteract axial rotation, or twisting of the golf club as described above, and another undesirable type of movement which may be referred to as axial slippage. Axial slippage is movement in a direction coincident with the longitudinal axis of the golf club's shaft, and this movement results from centrifugal force acting on the golf club during a golf swing. To the best of my knowledge, all prior art golf club grips have their groove patterns arranged in a way so that they counteract both types of undesirable movements.

There are many different groove arrays with an exemplary pattern being in the form of a plurality of independent relatively short groove segments which are arranged to lie on 45 angles relative to the longitudinal axis of the grip much like chevrons. This particular groove array has been used for many years on a well known and widely used grip known as a VICTORY Grip by Golf Pride. There are many variations of the chevron-like array used on other grips of Golf Pride and other manufacturers.

Another prior art grip used exclusively on PING Golf Clubs manufactured by Karsten Manufacturing Corporation is disclosed in my U.S. Pat. Des. 281,991 issued on Dec. 31, 1985. The grooves molded on this particular grip are arranged to provide a plurality of independent squares each being disposed so that a diagonal of the square is parallel to the longitudinal axis of the grip.

Since the grooves of the prior art grips described above lie on 45 angles relative to the longitudinal axis of the grips, they are not disposed to be in direct opposition to either of the undesirable movements which they are intended to counteract. To most efficiently counteract axial slippage movements, the grooves should .be arranged to lie in planes that are normal to the longitudinal axis of the grips. Similarly, to most efficiently counteract axial rotation, the grooves should be arranged parallel to the longitudinal axis of the grips.

Another type of prior art grip is disclosed in my U.S. Pat. Des. 254,926 issued on May 6, 1980. The grip of this patent has its grooves arranged to form independent squares that are disposed so that half of the grooves are in direct opposition to axial slippage movements; i.e. lie in planes normal to the longitudinal axis of the grips. The other half of the grooves are disposed to lie in direct opposition to axial rotation movements by being in parallel relationship to the longitudinal axis of the grip.

Another prior art golf club grip which is referred to as the "radial traction grip" by the Spalding Co. is provided with longitudinally extending grooves proximate the distal end of the grip. These longitudinally extending grooves are arranged in equally spaced circumferential increments about the grip and extend somewhat less then ⅓ the length of the grip from the distal end toward the proximal end. The remaining peripheral surface of this grip has angularly disposed grooves formed therein for counteracting the two types of unwanted golf club movement as hereinbefore described.

Still another prior art golf club grip is disclosed in U.S. Pat. Des. 307,169 by J. S. Aldridge which issued on Apr. 10, 1990. The grip shown in this design patent is provided with longitudinal grooves which extend almost the full length of the grip. However, those grooves are arranged to lie in a sector defined by an inscribed angle of about 110. Thus, only slightly more than ¼ of the peripheral surface of the grip of this design has the longitudinally extending grooves formed thereon. As in the prior art grip discussed immediately above, the remaining portions of this grip have angularly disposed grooves formed therein for counteracting the two types of previously described undesirable golf club movements.

I have found that the undesirable movement hereinbefore defined as axial slippage is adequately counteracted by the inherent tackiness of the materials used in molding golf club grips, and the relatively large distal ends of the tapered grip. Thus, the added traction provided by the grooves is not needed to counteract axial slippage movements. Therefore, a need exists for a new and improved golf club grip wherein all of the grooves formed therein are disposed to counteract the undesirable movement of golf club grips which is defined herein as axial rotation.

SUMMARY OF THE INVENTION

In accordance with the present invention, a new and improved golf club grip is disclosed as being especially configured to enhance the static friction exerting capabilities in a manner which maximizes the resistance to twisting of a golf club in the golfer's hands. To accomplish this objective, the grip of the present invention is provided with a groove array means wherein each groove of the array is parallel with respect to the longitudinal axis of the grip for directly opposing axial rotation of the grip and the golf club when it is being held by a golfer. The grip of the present invention is of conventional configuration in that it is of tubular frustoconical, or tapered configuration having a relatively small open end and a larger closed end. The grip may be formed in accordance with standard manufacturing techniques such as an injection molding process, and any suitable material may be used such as a rubber composition or the synthetic materials known in the art. The only difference between the golf club grip of the present invention and the prior art grip is the special groove array means which is molded or otherwise formed in the periphery of the grip body.

As mentioned above, all of the grooves which are formed in the grip of this invention are disposed to extend longitudinally of the grip. In other words, all of the grooves of the array are in parallel relationship with the longitudinal axis of the grip.

In the preferred embodiment, the groove array means formed in the grip includes a first plurality of longitudinally disposed grooves which extend from the closed distal end of the grip more than half of the length of the grip toward the open proximal end thereof. The first plurality of grooves are arranged in equally spaced radial increments so as to completely circumscribe the grip. The remaining area of the grip having no grooves formed therein provides a land area which is ideally suited for displaying a logo or brand name.

In a second embodiment, the groove array means formed in the grip includes a somewhat different first plurality of longitudinally extending grooves with the difference being that the grooves extend substantially the full length of the grip and like the preferred embodiment are disposed in equally spaced radial increments so as to circumscribe the grip. A few of the first plurality of longitudinally extending grooves, three in this embodiment, terminate in a set back location relative to the open end of the grip to provide a first land area for displaying a desired logo or brand name. Similarly, a second few of the first plurality of longitudinally extending grooves on the diametrically opposed surface of the grip terminate at a set back location from the open end of the grip to provide a second land area. Like the first land area, the second may be used for displaying a desired logo or brand name.

By locating the hereinbefore described land area or areas proximate the open end of the grip, the logo or brand name displayed thereon will be out from under the hands of a golfer whenever the golf club is being gripped in a normal manner to provide maximum exposure for the displayed logo or brand name. Furthermore, the entire surface of the grip which is normally engaged by a golfer's hands will have grooves formed therein for maximizing the static frictional contact between the grip and the hands.

The groove array means of the grip of the present invention also includes second plurality of longitudinally disposed grooves. The second plurality of grooves extends longitudinally from proximate the closed end of the grip and terminates at a location which is preferably approximately ⅓ of the distance between the opposite ends of the grip. The second plurality of grooves is disposed in equally spaced radial increments so as to circumscribe the grip and the grooves of the second plurality of grooves is arranged in an alternating interspersed relationship with the grooves of the first plurality of grooves. In other words, each groove of the second plurality of grooves is disposed to lie between a different adjacent pair of the grooves of the first plurality of grooves.

In that the grooves formed in the grip of the present invention extend longitudinally of the grip, they can be used as a visual indicator which aids the golfer in repeatedly achieving desired golf club head positioning. In most golf shots, the face of the golf club head should be square to the intended flight path of the golf ball at the time of impact, and it is difficult if not impossible to achieve this unless the face is square when the golfer is addressing the ball prior to beginning the swing. The grooves can help a golfer repeatedly achieve the desired face alignment, or by rotating the club about the longitudinal axis of the shaft, the face can be opened or closed as needed to make special golf shots. The visual indicator means of the grip of the present invention is located at the distal end of the grip on the surface of the grip which is facing upwardly when the golfer is gripping the club and addressing the ball. The grooves on opposite sides of the centrally located upwardly facing groove are set back a short distance from the distal end of the grip so that a golfer can quickly and positively identify the groove or grooves which are to be used for the club aligning operation. Actual alignment is accomplished by visually aligning the indicator with the heel of the left hand which is proximate the indicator when the golfer is properly gripping the club. In the case of a left-handed golfer, the aligning process will use the heel of the right hand, but the process is otherwise the same.

In another embodiment of the present invention, the first plurality of grooves is formed in the grip in the same manner as in the above described second embodiment. In other words, the first plurality of grooves extends longitudinally the full length of the grip, and the grooves are disposed in equally spaced radial increments so as to circumscribe the grip. Selected ones of the grooves on diametrically opposed sides of the grip are terminated short of the open end of the grip to provide first and second land areas for displaying a logo or brand name. The first and second land areas of this third embodiment of the present invention are located on the grip so that they will be disposed on opposite laterally facing surfaces of the grip when it is being held by a golfer while addressing the golf ball. In the manner of the first and second embodiments described above, a second plurality of longitudinally disposed grooves are arranged in equally spaced radial increments so as to circumscribe the grip, and those grooves are arranged in an alternating interspersed relationship with the grooves of the first plurality of grooves. The grooves of the second plurality of grooves extend longitudinally from proximate the closed end of the grip and terminate at a location which is approximately ⅔ of the distance between the opposite ends of the grip.

In a fourth embodiment of the present invention, a single plurality of longitudinally extending grooves is formed in the grip so as to extend more than half of the length of the grip. The grip of this embodiment is preferably provided with the logo and/or brand name display area and may also have a visual indicator means as hereinbefore described. Due to the tapered configuration of the grips, the space between each of the grooves gradually becomes smaller to accommodate the gradually decreasing diameter of the grip between the relatively large diameter at the closed end of the grip and the smaller diameter at the open end thereof.

In a modification of the hereinbefore described fourth embodiment of the grip of the present invention, the spacing problem resulting from the tapered configuration of the grip is accommodated by gradually reducing the width of the grooves thus allowing the spaces between the grooves to remain constant throughout the length of the grips.

In a fifth embodiment, the golf club grip of the present invention is provided with an array of ridges which are preferably disposed on the grip in the same configuration as the groove array means of the preferred embodiment of the present invention.

Accordingly, it is an object of the present invention to provide a new and improved golf club grip which is configured to improve the resistance to axial rotation of a golf club in a golfer's hands.

Another object of the present invention is to provide a new and improved golf club grip having a groove array means formed therein for enhancing the static friction exerting capabilities of the grip to maximize the resistance to twisting of a golf club in the hands of a golfer.

Another object of the present invention is to provide a new and improved golf club grip of the above described character wherein the grooves of the groove array means extend longitudinally of the grip for directly opposing rotation of the golf club about the longitudinal axis of the golf club shaft when the grip is being held in the hands of a golfer.

Another object of the present invention is to provide a new and improved golf club grip of the above described type wherein the groove array means includes a first plurality of grooves which extend longitudinally from the closed end of the grip for more than half of the length of the grip and are disposed in equally spaced radial increments so as to circumscribe the grip and a second plurality of grooves extending longitudinally from the closed end of the grip toward the open end thereof a distance which is less than the extending length of the first plurality of the grooves, the second plurality of grooves being disposed in equally spaced radial increments so as to circumscribe the grip and being arranged in alternating interspersed relationship with the first plurality of grooves.

Still another object of the present invention is to provide a new and improved golf club grip of the above described character wherein the first plurality of grooves extend substantially the full length of the grip with some of the first plurality of grooves being set back from the open end of the grip to provide at least one land area for displaying a logo and/or brand name.

Yet another object of the present invention is to provide a new and improved golf club grip of the above described type and further including a visual indicator means for visual alignment of the golf club in the hands of the golfer.

The foregoing and other objects of the present invention as well as the invention itself may be more fully understood from the following description when read in conjunction with the accompanying drawings.

BRIEF DESCRIPTION OF THE DRAWINGS

FIG. 6 is a view similar to FIG. 2 and showing a third embodiment of the golf club grip of the present invention.

FIG. 7 is an enlarged fragmentary view showing a portion of a modified version of the grip shown in FIG. 6.

FIG. 8 is another view similar to FIG. 2 and showing still another embodiment of the golf club grip of the present invention.

DESCRIPTION OF THE PREFERRED EMBODIMENTS

Figure 1:
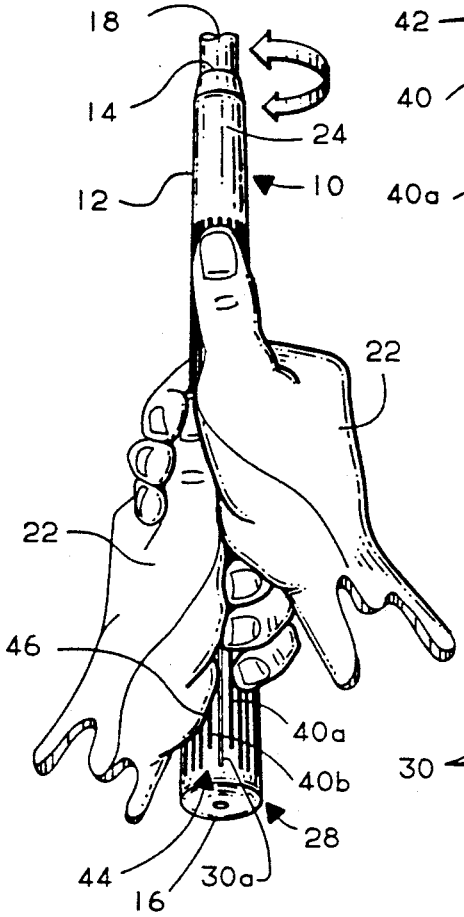
FIG. 1 is a fragmentary view looking down on a golfer's hands which are holding a preferred embodiment of the golf club grip of the present invention.
Figure 2:
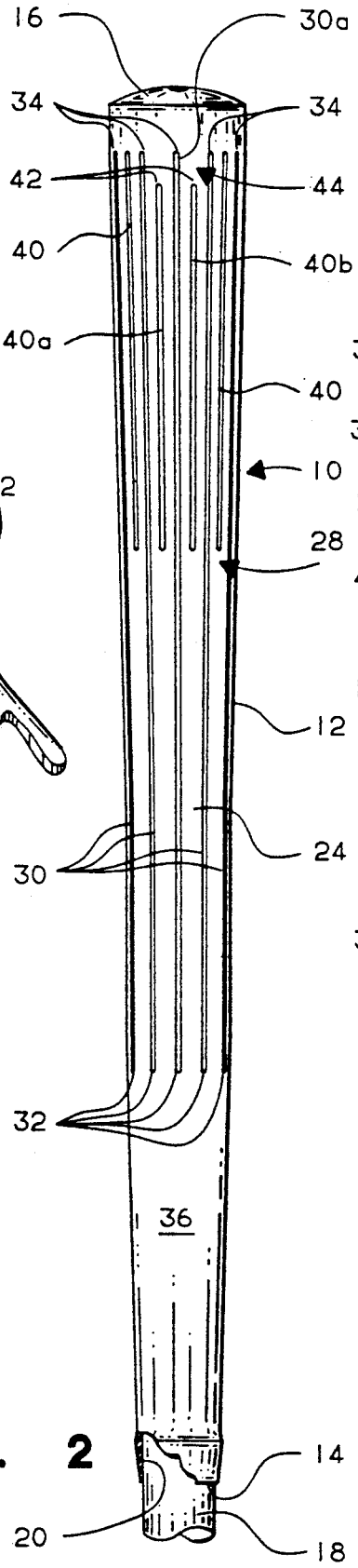
FIG. 2 is an enlarged view of the golf club grip shown in FIG. 1 and showing the surface of the grip which faces upwardly when the grip is installed on the shaft of a golf club and is being held in a golf ball addressing position by a golfer in the manner shown in FIG. 1.
Figure 3:
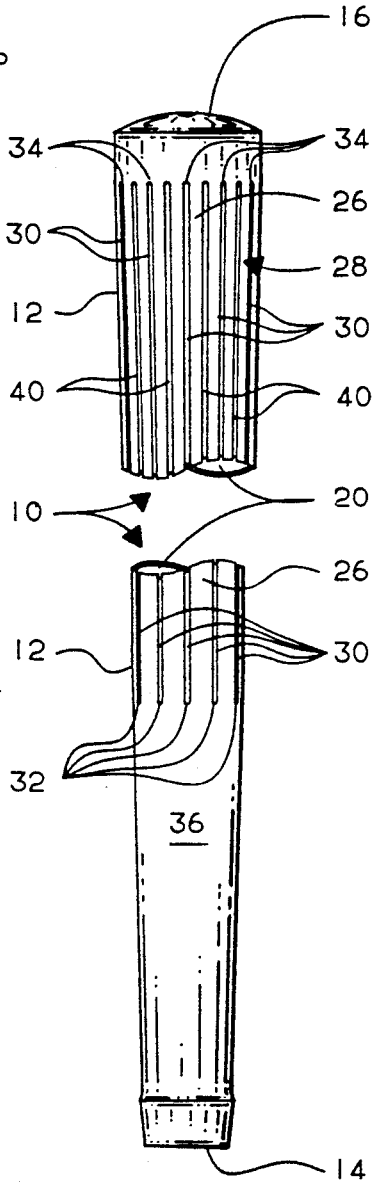
FIG. 3 is a view of the golf club grip shown in FIGS. 1 and 2 and showing the lower or downwardly facing surface of the grip when installed on the shaft of a golf club and is being held in the golf ball addressing position.

Referring more particularly to the drawings, FIGS. 1-3 show the preferred embodiment of the golf club grip of the present invention which is indicated generally by the reference numeral 10. The grip 10 included a tubular body 12 of conventional configuration having a tapered, or frusto-conical shape with a relatively small open end 14 and a larger end 16 which is closed by an end cap. The grip 10 may be formed of any suitable material such as a rubber composition or a synthetic composition and the grip may be manufactured such as by employing an injection molding technique as is well known in the art.

The grip 10 is designed to be mounted on the shaft 18 of a golf club (not shown) in the usual manner by coaxially sliding the end of the shaft 18 into the blind bore 20 of the grip 10 through the open end 14 thereof. The grip may be mounted fast on the shaft 18 by using double sided tape (not shown) in accordance with well known techniques. When mounted on the shaft 18 in this manner, the open end 14 of the grip 10 may be referred to a the proximal end and the closed end 16 as the distal end. Further, when a golfer is gripping a golf club in his or her hands 22 as shown in FIG. 1 and is addressing a ball (not shown), prior to starting the golf swing, the grip 10 will have an upper surface 24 which faces upwardly at the address position. Consequently, as shown in FIG. 3 the grip will also have a diametrically opposed lower, or downwardly facing surface 26.

In accordance with the present invention, the golf club grip 10 is provided with an especially configured groove array means 28 which may be molded or otherwise formed in the peripheral surface of the grip body 12 at the time of manufacture. In the preferred embodiment, the grip array means 28 includes a first plurality of grooves 30 which extend longitudinally from proximate the distal end 16 of the grip body 12 toward the proximal end 14 a distance which is greater than half of the length of the grip body and may be approximately $\frac{2}{3}$ or $\frac{3}{4}$ of the length of the body. The grooves 30 are arranged in equally spaced radial increments so as to circumscribe, or surround the grip body 12.

As seen best in FIG. 2, the grooves 30 have terminal ends 32 and 34, and, as indicated above, the terminal ends 32 are in spaced, set back relationship with respect to the proximal end 14 of the grip body 12 to provide a land area 36 adjacent the proximal end of the grip and that land area 36 circumscribes the grip body 12. A suitable logo, brand name or other indicia (not shown) may be displayed on this land area 36.

The preferred embodiment of the grip 10 of the present invention further includes a second plurality of grooves 40 which are part of the grip array means 28. The second plurality of grooves 40 extends longitudinally from proximate the closed, or distal end 16 of the grip 10 and terminates at a location which is less than half of the distance between the opposite ends 14 and 16 of the grip. It is preferred that the second plurality of grooves 40 terminates at a point which is approximately $\frac{1}{3}$ of the distance between the opposite ends of the grip. The second plurality of grooves 40, like the first plurality of grooves 30, is disposed in equally spaced radial increments so as to circumscribe the grip 10. The individual grooves of the second plurality of grooves 40 are arranged in an alternating interspersed relationship with the grooves of the first plurality of grooves 30. In other words, each groove of the second plurality of grooves 40 is disposed so as to lie between a different adjacent pair of the grooves of the first plurality of grooves 30.

It will now be appreciated that in the preferred embodiment of the grip of the present invention, the groove density i.e. the number of grooves at the distal end of the grip 10 is double that of the remainder of the grip. In the hands of a right handed golfer, the left hand will grip the golf club at the distal end of the grip 10 and thus the static friction exerted between the left hand and the distal end of the grip will be maximized. In that the groove density is less in the area which is gripped by the golfer's right hand, the static friction exertion capability is less in that area than it is in the area gripped by the left hand.

In accordance with widely accepted golf swing theory, the left hand of a right handed golfer should be the "strong" hand; that is, the one exerting the most influence on the golf club during the swing. This leaves the right hand as being relegated to a weaker position which ideally exerts a lesser amount of influence on the golf club during the swing. Of course, with a left handed golfer, everything is reversed but the effect remains the same.

The grip 10 is designed to provide a maximum static friction exerting capability; i.e. resistance to relative movement, in the area gripped by a golfer's "strong" hand and a lesser static friction exerting capability in the area gripped by a golfer's "weak" hand In addition, the longitudinal disposition of the first and second plurality of grooves 30 and 40 respectively, place them in direct opposition; i.e. perpendicular to the direction of rotation of the golf club about the longitudinal axis of the shaft of the golf club. Therefore, the longitudinal disposition of the grooves will counteract the tendency for a golf club to twist in the hands of a golfer as a result of off center impacting of a golf ball toward the toe or heel of the golf club head.

As seen best in FIG. 2, one of the first plurality of grooves, herein identified by the reference number **30*a*, is centrally located on the upwardly facing surface 24 of the grip 10 and will thus face upwardly when the grip is being held by a golfer when addressing the ball. The particular grooves 40*a* and 40*b* of the second plurality of grooves 40, which are located on opposite sides of the central groove 30*a*, have their ends 42 set back from the distal end 16 of the grip, a distance which is greater than the set back relationship of the other grooves 30 and 40. These set back ends 42 serve to quickly and positively allow a golfer to locate the general area of the grooves 30*a*, 40*a* and 40*b*. That general area 44** provides a visual indicator means by which a golfer can quickly and repeatedly achieve a desired club head face positioning.

As seen in FIG. 1, the visual indicator means 44 is visible to a golfer when holding a golf club in the address position, and the ends of the three grooves **30*a*, 40*a* and 40*b* which make up the visual indicator means 44 are proximate the heel 46 of the golfer's left hand. By learning to visually align the visual indicator means 44 relative to his or her hands 22, the golfer can accurately and repeatedly position the face of the golf club head in a position that is square to the intended flight path of a golf ball. Further, by rotating the golf club about the longitudinal axis of the shaft 18, and using the visual indicator means 44** as described, the golfer can more accurately close or open the face of the golf club for accomplishing specialized golf shots.

Figure 4:
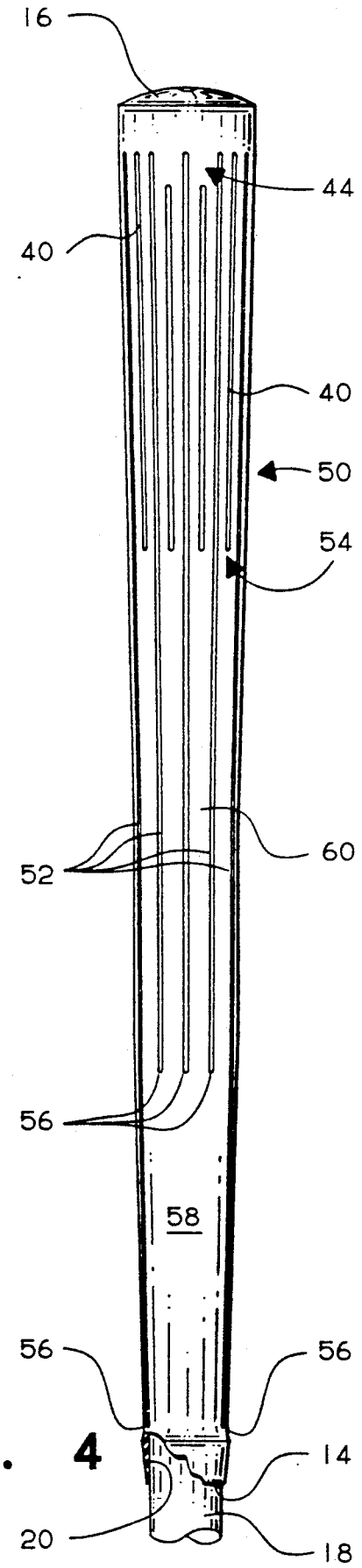
FIG. 4 is a view similar to FIG. 2 and showing a second embodiment of the golf club grip of the present invention.
Figure 5:
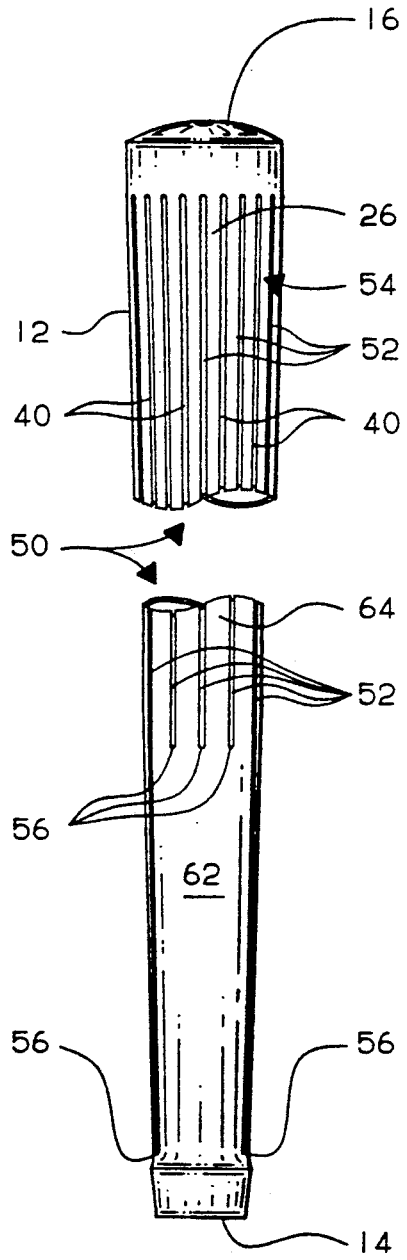
FIG. 5 is a view of the golf club shown in FIG. 4 and showing the lower or downwardly facing surface of the grip when installed on the shaft of a golf club and is being held in the golf ball addressing position.

In the second embodiment of the present invention shown in FIGS. 4 and 5, the grip 50 is similar in all respects to the hereinbefore described grip 10 except for two differences which will now be described in detail. The first difference is that the first plurality of grooves 52 of the groove array means 54 extend longitudinally from proximate the distal end 16 of the grip body to proximate the proximal end 14 thereof. As shown in FIG. 4, some of the grooves 52, three in the illustrated embodiment, have their terminal ends 56 in spaced set back relationship with respect to the proximal end of the grip 50 to provide a first land area 58 adjacent to the proximal end of the grip and disposed on the upper surface 60 thereof. As seen in FIG. 5, a second land area 62 may be similarly provided on the lower surface 64 of the grip by locating the terminal end 56 of additional ones of the grooves 52 in spaced set back relationship with respect to the proximal end 14 of the grip 50. From the above, it will be appreciated that the second difference between the grip 10 and the grip 50 is that the grip of the second embodiment is provided with top and bottom land areas 58 and 62 as opposed to the single land area 36 of the grip 10 of the first embodiment. It will be understood that a logo, brand name or other indicia may be displayed in one or both of the land areas 58 and 62.

In the third embodiment of the present invention shown in FIG. 6, the grip 66 is similar to the hereinbefore described grip 10 insofar as its tapered shape and the like are concerned. This grip 66 differs from the grip 10 in the configuration of the groove array 68 which is formed in the peripheral surface of the grip body 70. As shown, the groove array 68 includes a single plurality of grooves 72 which extends substantially the full length of the grip body 70 and is disposed in equally spaced radial increments so as to circumscribe the grip body 70. If desired, one of the longitudinal grooves can be omitted to form a longitudinally extending land area 74 which provides the grip 66 with a visual alignment area 76 proximate the closed end 16 of the grip body 70.

It will be seen that the area between the individual groove 72 which forms the groove array 68 of the grip 66 of the third embodiment, diminishes in width from the relatively larger diameter end 16 to the smaller diameter end 14 of the grip. This, of course, is necessitated by the tapered configuration of the grip. In a modified grip 66*a* as shown in FIG. 7, this same requirement is satisfied by the individual grooves 72*a* being widest near the closed end 16 of the modified grip 66*a* with the individual grooves gradually diminishing in width.

In a fourth embodiment, the golf club grip 80 shown in FIG. 8 is similar to the grip 50 hereinbefore fully described. There are two differences between the grip 50 and the grip 80. The first difference is that the individual grooves 82 which make up the second plurality of grooves of the groove array means 83 extend longitudinally from a position proximate the closed end 16 of the grip to a location 84 which is approximately ⅔ of the distance between the opposite ends 14 and 16 of the grip body 86. The second difference between the grips 50 and 80 is that the grip 80 has a pair of diametrically opposed land areas 88 which are disposed so as to face laterally with respect to the upwardly facing surface 90 of the grip body 86.

Figure 9:
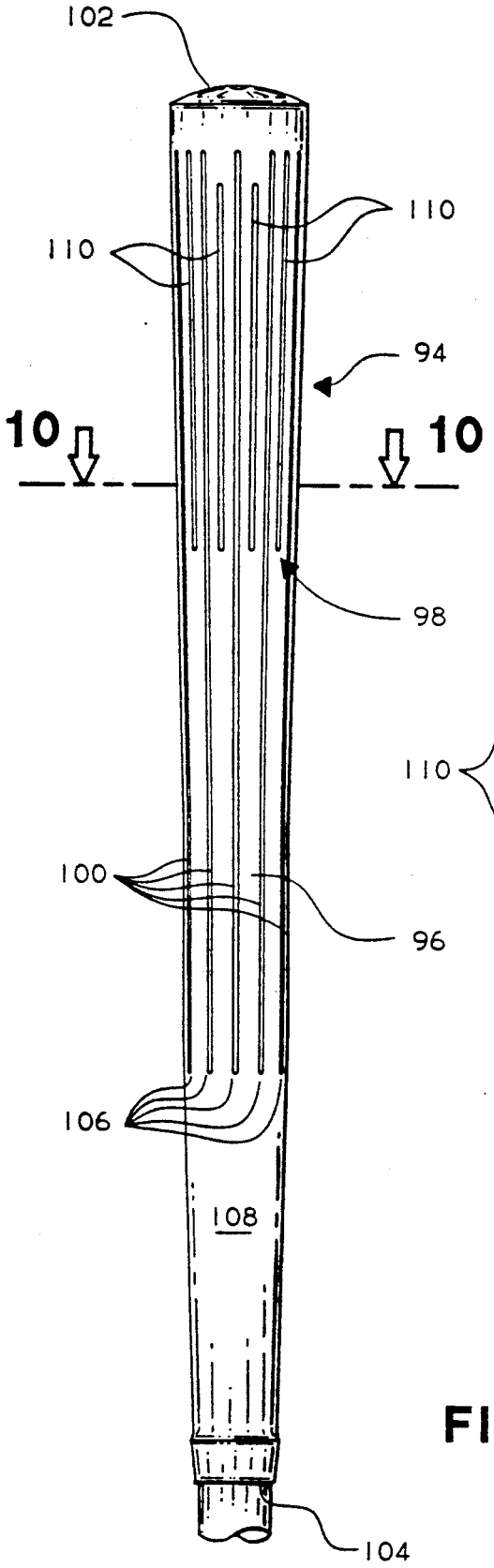
FIG. 9 is another view similar to FIG. 2 and showing yet another embodiment of the golf club grip of the present invention.
Figure 10:
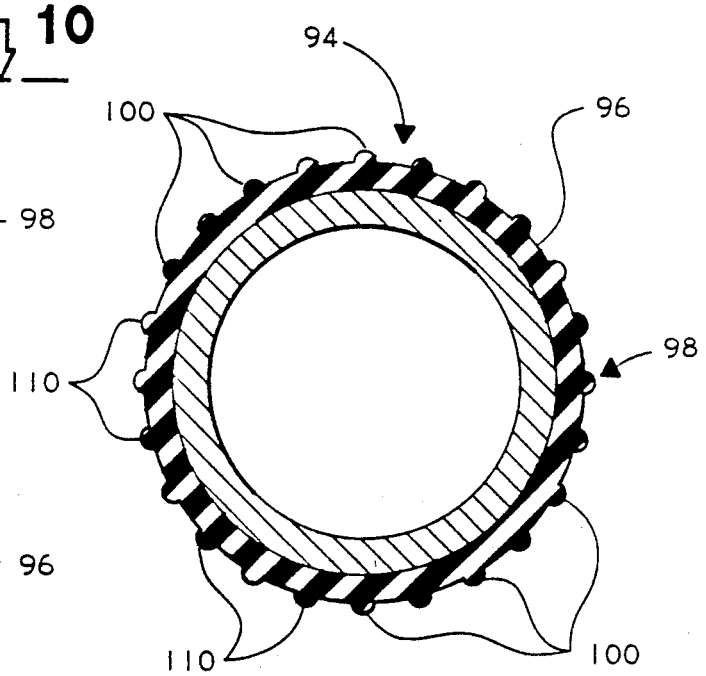
FIG. 10 is an enlarged fragmentary sectional view taken along the Line 10—10 of FIG. 9.

In still another embodiment shown in FIGS. 9 and 10, the grip which is indicated generally by the reference numeral 94, is similar to the hereinbefore described grips with regard to its tapered configuration, materials of which it is formed and the like. This grip 94 differs from the grips previously described in that ridges are provided in the grip body 96 instead of grooves to provide the desired resistance to rotation in a golfer's hands.

In accordance with this embodiment of the present invention, the golf club grip 94 is provided with an especially configured ridge array means 98 which may be molded or otherwise formed in the peripheral surface of the grip body 96. The ridge array means 98 includes a first plurality of ridges 100 which extend longitudinally from proximate the distal end 102 of the grip body toward the proximal end 104 thereof a distance which is approximately ¾ of the length of the grip. The ridges 100 are arranged in equally spaced radial increments so as to circumscribe the grip body 96.

In this illustrated embodiment the terminal ends 106 of the ridges 100 are set back from the proximal end 104 of the body 96, as indicated above, to provide a land area 108 of the same configuration and for the same purposes as the land area 36 of the first embodiment of the present invention.

A second plurality of ridges 110, which are part of the ridge array means 98, are provided on the grip 94. This second plurality of ridges 110 extends longitudinally from proximate the closed distal end 102 of the body 96 and terminates at a location which is preferably approximately ⅓ of the distance between the opposite ends of the grip. Each of the ridges of the second plurality of ridges 110 are disposed in equally spaced radial increments so as to circumscribe the grip body and are arranged in an alternating interspersed relationship with the ridges of the first plurality of ridges 100.

It will now be seen that the ridge array means 98 formed on the grip 94 is disposed in the same manner as the groove array means 28 formed in the grip 10. Thus, the grip 94 will function in the same manner as the grip 10, and repeating the hereinbefore functional description is deemed as being unnecessary. Further, it will be appreciated that the ridge array means 98 could be modified in the manner of the groove arrays of the other embodiments hereinbefore described.

While the principles of the invention have now been made clear in illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles.

The appended claims are therefore intended to cover and embrace any such modifications within the limits only of the true spirit and scope of the invention.

What I claim is:

1. A grip for mounting on the extending end of a shaft of a golf club, said grip comprising:

a) a tubular body of elongated frusto-conical configuration with a closed end of relatively large diameter and a smaller diameter open end for slidably and coaxially receiving the extending end of the shaft of the gold club; and b) said body having a groove array means formed in the peripheral surface thereof for maximizing the static friction exerting capability of said grip to resist rotation of the golf club in a golfer's hands about the longitudinal axis of the shaft of the golf club, said groove array means including, I. a first plurality of grooves formed in said body in spaced radial increments so as to circumscribe said body, said first plurality of grooves extending longitudinally from proximate the closed end of said body for a distance which is more than half the length of said body, II. a second plurality of grooves formed in said body in spaced radial increments so as to circumscribe said body, said second plurality of grooves being in alternating interspersed relationship with the grooves of said first plurality of grooves and extending longitudinally from proximate the closed end of said body for a distance which is less then the extending distance of said first plurality of grooves, whereby the distances which the first and second plurality of grooves extend are such that the static friction exertion capability is maximized for the golfer's hand proximate the closed end of the grip and is lessened for the hand proximate the opened end of the grip.

2. A grip as claimed in claim 1 wherein said grooves of said groove array means are formed in said body in equally spaced radial increments on the peripheral surface of said body.

3. A grip as claimed in claim 1 wherein each of the grooves of said first plurality of grooves extend approximately $\frac{2}{3}$ of the length of said body.

4. A grip as claimed in claim 1 wherein each of the grooves of said first plurality of grooves extend approximately $\frac{3}{4}$ of the length of said body.

5. A grip as claimed in claim 1 wherein at least some of the grooves of said first plurality of grooves extend substantially the full length of said body.

6. A grip as claimed in claim 1 wherein some of the grooves of said first plurality of grooves extend substantially the full length of said body and others of the grooves of said first plurality of grooves extend less than the full length of said body to provide at least one land area means proximate the open end of said body for displaying indicia.

7. A grip as claimed in claim 6 wherein said land area means is located on said body so as to face upwardly when said grip is mounted on the shaft of the golf club and is being held in a golf ball addressing position by a golfer.

8. A grip as claimed in claim 6 wherein said land area means includes a diametrically opposed pair of land areas which are in oppositely facing vertically disposed positions when said grip is mounted on the shaft of the golf club and is being held in a golf ball addressing position by a golfer.

9. A grip as claimed in claim 6 wherein said land area means includes a diametrically opposed pair of land areas which are in oppositely facing laterally disposed positions when said grip is mounted on the shaft of the golf club and is being held in a golf ball addressing position by a golfer.

10. A grip as claimed in claim 1 wherein said second plurality of grooves formed in said body extends longitudinally from proximate the closed end of said body to a location which is approximately $\frac{1}{2}$ of the distance between the opposite ends of said body.

11. A grip as claimed in claim 1, and further comprising indicator means formed on said body for visual alignment of said indicator means with the hands of a golfer for determining the axially rotated position of the shaft of the golf club when being held in a golf ball addressing position.

12. A grip as claimed in claim 11 wherein said indicator means is formed in said body proximate the closed end thereof and is disposed for visual alignment with the heel of a golfer's hand when being gripped in a golf ball addressing position.

13. A grip as claimed in claim 11 wherein said indicator means comprises:

a) one of said plurality of grooves of said groove array means being located centrally of said body so as to face upwardly when said grip is being held in a golf ball addressing position by the golfer, said central one of said plurality of grooves having a terminal end proximate the closed end of said body; and b) each of the grooves of said plurality of grooves that are immediately adjacent and on opposite sides of said central one of said plurality of grooves having a terminal end which is set back relative to the terminal end of said central one of said plurality of grooves in a direction away from the closed end of said body.

14. A grip for mounting on the extending end of a shaft of a golf club, said grip comprising:

a) a tubular body of elongated frusto-conical configuration with a closed end of relatively large diameter and a smaller diameter open end for slidably and coaxially receiving the extending end of the shaft of the golf club; and b) said body having a groove array means form ed in the peripheral surface thereof for maximizing the static friction exerting capability of said grip to resist rotation of the golf club in a golfer's hands about the longitudinal axis of the shaft of the golf club, said groove array means including, I. a first plurality of grooves formed in said body and disposed in equally spaced radial increments so as to circumscribe said body, said first plurality of grooves extending substantially the full length of said body, II. a second plurality of grooves formed in said body and disposed in equally spaced radial increments so as to circumscribe said body, said second plurality of grooves being in alternating interspersed relationship with the grooves of said first plurality of grooves and extending longitudinally from proximate the closed end of said body for less than the full length of said body, whereby the distances which the first and second plurality of grooves extend are such that the static friction exertion capability is maximized for the golfer's hand proximate the closed end of the grip and is lessened for the hand proximate the opened end of the grip.

15. A grip as claimed in claim 14 wherein said second plurality of grooves formed in said body extend longitudinally from proximate the closed end of said body to a location which is approximately $\frac{2}{3}$ of the distance between the opposite ends of said body.

16. A grip as claimed in claim 14 wherein said second plurality of grooves formed in said body extends longitudinally from proximate the closed end thereof to a location which approximately $\frac{1}{2}$ of the distance between the opposite ends of said body.

17. A grip for mounting on the extending end of a shaft of a golf club, said grip comprising:

a) a tubular body of elongated frusto-conical configuration with a closed end of relatively large diameter and a smaller diameter open end for slidably and coaxially receiving the extending end of the shaft of the golf club; and b) said body having a ridge array means protruding from the peripheral surface thereof for maximizing the static friction exerting capability of said grip to resist rotation of the golf club in a golfer's hands about the longitudinal axis of the shaft of the gold club, said ridge array means including, I. a first plurality of ridges protruding from said body and disposed in spaced radial increments so as to circumscribe said body, said first plurality of ridges extending longitudinally from proximate the closed end of said body for more than half the length of said body, II. a second plurality of ridges protruding from said body and disposed in spaced radial increments so as to circumscribe said body, said second plurality of ridges being in alternating interspersed relationship with the ridges of said first plurality of ridges and extending longitudinally from proximate the closed end of said body for less than half the length of said body, whereby the distances which the first and second plurality of ridges extend are such that the static friction exertion capability is maximized for the golfer's hand proximate the closed end of the grip and is lessened for the hand proximate the opened end of the grip.

18. A grip as claimed in claim 17 wherein said ridges of said ridge array means are formed in said body in equally spaced radial increments on the peripheral surface of said body.

19. A grip as claimed in claim 17 wherein each of the ridges of said first plurality of ridges extend approximately $\frac{2}{3}$ of the length of said body.

20. A grip as claimed in claim 17 wherein each of the ridges of said first plurality of ridges extend approximately $\frac{3}{4}$ of the length of said body.

21. A grip as claimed in claim 17 wherein said second plurality of ridges formed in said body extends longitudinally from proximate the closed end thereof to a location which is approximately $\frac{1}{3}$ of the distance between the opposite ends of said body.

22. A grip as claimed in claim 17 and further comprising indicator means formed on said body for visual alignment of said indicator means with the hands of a golfer for determining the axially rotated position of the shaft of the golf club when being held in a golf ball addressing position.

23. A grip as claimed in claim 22 wherein said indicator means is formed in said body proximate the closed end thereof and is disposed for visual alignment with the heel of a golfer's hand when being gripped in a golf ball addressing position.

24. A grip as claimed in claim 22 wherein said indicator means compromises:

a) one of said plurality of ridges of said ridge array means being located centrally of said body so as to face upwardly when said grip is being held in a golf ball addressing position by the golfer, said central one of said plurality of ridges having a terminal end proximate the closed end of said body; and b) each of the ridges of said plurality of ridges that are immediately adjacent and on opposite sides of said central one of said plurality of ridges having a terminal end which is set back relative to the terminal end of said central one of said plurality of ridges in a direction away from the closed end of said body.

* * * * *